US009307815B2

(12) United States Patent
Sijmons et al.

(10) Patent No.: US 9,307,815 B2
(45) Date of Patent: Apr. 12, 2016

(54) LUGGAGE WITH SHELL, FRAME, AND LOCK

(71) Applicant: Samsonite IP Holdings S.ar.l., Luxembourg (LU)

(72) Inventors: Erik Sijmons, Oudenaarde (BE); Rik Hillaert, Oudenaarde (BE); Guy Moerman, Oudenaarde (BE); Kenneth Coene, Aalbeke (BE)

(73) Assignee: Samsonite IP Holdings S.a r.l., Luxembourg (LU)

( * ) Notice: Subject to any disclaimer, the term of this patent is extended or adjusted under 35 U.S.C. 154(b) by 0 days.

(21) Appl. No.: 14/334,444

(22) Filed: Jul. 17, 2014

(65) Prior Publication Data

US 2015/0021132 A1 Jan. 22, 2015

(30) Foreign Application Priority Data

Jul. 19, 2013 (EP) ..... 13177244

(51) Int. Cl.

| | |
|---|---|
| ***A45C 5/03*** | (2006.01) |
| ***A45C 5/14*** | (2006.01) |
| ***A45C 13/04*** | (2006.01) |
| ***A45C 13/10*** | (2006.01) |

(52) U.S. Cl.

CPC ... *A45C 5/03* (2013.01); *A45C 5/14* (2013.01); *A45C 13/04* (2013.01); *A45C 13/1084* (2013.01)

(58) Field of Classification Search

CPC .. A45C 2005/037; A45C 13/04; A45C 13/36; A45C 13/1084; A45C 5/03

USPC ..... 190/18 A, 24, 119, 122, 123, 125–127, 190/120; 70/69.73; 220/4.22

See application file for complete search history.

(56) References Cited

U.S. PATENT DOCUMENTS

| | | | | |
|---|---|---|---|---|
| 2,200,972 | A * | 5/1940 | Stein | 190/123 |
| 2,743,029 | A * | 4/1956 | Mautner | 217/56 |
| 2,805,077 | A * | 9/1957 | Katz | 280/47.131 |
| 3,292,749 | A * | 12/1966 | Reading | 190/119 |

(Continued)

FOREIGN PATENT DOCUMENTS

| | | |
|---|---|---|
| CN | 201403677 Y | 2/2010 |
| CN | 202051108 U | 11/2011 |

(Continued)

OTHER PUBLICATIONS

Extended European Search Report dated Dec. 20, 2013 for Application No. 13177244.4, 7 pages.

*Primary Examiner* — Sue A Weaver
(74) *Attorney, Agent, or Firm* — Dorsey & Whitney LLP

(57) ABSTRACT

A luggage piece may include a first shell and a second shell pivotably joined to the first shell. The luggage piece may include a clamp-type latch configured to releasably secure the first shell to the second shell. The luggage case may further include a frame assembly. The frame assembly may include opposing first and second frame members. The first frame member and the second frame member may be joined to the first shell and the second shell, respectively. The first and second frame members may be pivotably joined together by a hinge. The first frame member may be configured with a first recess to receive therein at least a portion of the clamp-type latch such that exterior surfaces of the first shell, the first frame member, and the clamp-type latch are substantially flush with each other when the clamp-type latch is positioned in its latched position.

17 Claims, 7 Drawing Sheets

(56) References Cited

U.S. PATENT DOCUMENTS

| | | | | | |
|---|---|---|---|---|---|
| 3,335,827 | A | * | 8/1967 | Hofferbert | 190/125 |
| 3,497,041 | A | * | 2/1970 | Samhammer | 190/18 R |
| 3,730,309 | A | * | 5/1973 | Hamann et al. | 190/127 |
| 4,094,392 | A | * | 6/1978 | Gregg et al. | 190/120 |
| 4,509,622 | A | * | 4/1985 | Morszeck | 190/119 |
| 4,540,071 | A | | 9/1985 | Schaub et al. | |
| 5,044,476 | A | | 9/1991 | Seynhaeve | |
| 5,111,918 | A | | 5/1992 | Bako et al. | |
| 5,197,578 | A | * | 3/1993 | Van Hooreweder | 190/18 A |
| 5,461,892 | A | * | 10/1995 | Hsieh | 70/73 |
| 5,924,533 | A | * | 7/1999 | Cnockaert et al. | 190/18 A |
| 2001/0013452 | A1 | * | 8/2001 | Tiramani et al. | 190/124 |

FOREIGN PATENT DOCUMENTS

| | | | |
|---|---|---|---|
| EP | 0513854 | A2 | 11/1992 |
| FR | 2711491 | A1 | 5/1995 |
| GB | 1056139 | A | 1/1967 |
| WO | 96/02424 | A1 | 2/1996 |
| WO | 2010029580 | A1 | 3/2010 |
| WO | 2010029581 | A1 | 3/2010 |
| WO | 2010029583 | A1 | 3/2010 |

* cited by examiner

LUGGAGE WITH SHELL, FRAME, AND LOCK

CROSS-REFERENCE TO RELATED APPLICATION

This application claims priority to European Patent Application No. 13177244.4, filed on Jul. 19, 2013 and entitled "Luggage With Shell, Frame, and Lock", which is hereby incorporated in its entirety by reference as though fully disclosed herein.

TECHNOLOGICAL FIELD

The present disclosure generally relates to luggage. More particularly, the present disclosure relates to hard side luggage items with a frame assembly.

BACKGROUND

Luggage cases are often used for travelers to transport items. Among various types of luggage cases, hard side luggage cases have gained popularity. Hard side luggage cases may typically include two opposing shells, closure and/or locking mechanisms attached to the shells, carry handles, telescoping handles, and wheels. The shells of hard side luggage cases may be made from polymeric materials, which may allow the shells to retain their shape upon impact yet still flex to a certain extent to absorb the impact. Compared to soft side luggage panels, which may generally be made from fabric materials, hard side luggage shells may withstand abrasion, punctures, contaminants, such as dirt and moisture, among other things, better than soft side luggage panels and last longer than soft side luggage panels. Depending on the materials used for forming the shells of the hard side luggage case, the hard side luggage cases may have a weight comparable to, in some cases even lighter than, the weight of soft side luggage cases.

Still, there is room for improvement in hard side luggage cases. In a typical hard side luggage case, peripheral components, such as handles and locks, may usually be attached to the exterior of the luggage shells and project or extend outwardly from the outer surface of the luggage shells. Such projection or extension may increase the luggage's exterior dimensions as measured by airline services and can reduce the amount of interior space available for storing items in the luggage, which may be undesirable for luggage items subject to size restrictions, such as carry-on luggage. Another issue with projected peripheral components is these components may experience more bumps, scuffs or abrasions, among other things, as compared to the shells during usage. As a result, the luggage case may not function well because of damaged locks or handles that need to be repaired or replaced even though the shells may have no or little damage. For a similar reason, the closure mechanism between the shells, such as a zipper mechanism, may be more likely to be damaged due to their raised profile from the luggage shell exterior.

Some hard side luggage cases may employ a latch/locking mechanism instead of a zipper mechanism. Shells of such suitcases may generally be heavy and thick in order to provide sufficient rigidity for the shells to retain their shapes and to form a proper seal/closure at the opposing edges/rims where the two shells meet. Some hard side cases may utilize peripheral frames to reinforce the shells along the edges/rims thereof so that lighter shells may be used. Such peripheral frames do not protect the peripheral components, such as handles and/or locks, from scuffs, abrasions as discussed above since the locks and handles still remain raised from the outer surface of the luggage case. Alternatively, heavy-duty components may be used to improve the durability. These components may, however, increase the cost and/or the weight of the luggage cases.

Documents that may be related to the present disclosure in that they include various approaches to hard side luggage construction include WO2010/029580, WO2010/029581, WO2010/029583, GB1056139, U.S. Pat. No. 4,540,071, U.S. Pat. No. 5,044,476, CN201403677, and CN202051108. These proposals, however, may be improved.

It is therefore desirable to provide an improved luggage construction, in particular an improved hard side luggage construction, which addresses the above described problems and/or which more generally offers improvements or an alternative to existing hard side luggage structures and construction methods.

SUMMARY

According to the present invention there is therefore provided a hard side luggage piece and a method of making the same as defined in the accompanying claims.

One aspect of the invention may include a luggage piece with a latch and a peripheral frame assembly that are substantially flush with the luggage shell.

In one such example, the luggage piece may include a first shell, a second shell, and a frame assembly. The frame assembly may include opposing first and second frame members. The first frame member may be joined to the first shell. The second frame member may be joined to the second shell. The first and second frame members may be pivotably joined together by a hinge. The luggage piece may further include a first clamp-type latch joined to the frame assembly. The first clamp-type latch may be configured to releasably secure the first shell to the second shell. The first frame member may include a first recess. The first recess may receive therein at least a portion of the first clamp-type latch. Proximate the first recess, an exterior surface of a portion of the first shell adjacent to the first frame member may be substantially flush with an exterior surface of an adjacent portion of the first frame member. An exterior surface of the first clamp-type latch may be substantially flush with an exterior surface of an adjacent portion of the first frame member when the first clamp-type latch is positioned in a latched position.

Another aspect of the invention may include a luggage piece with a first carry handle with a pivoting axis that is internal to the luggage case and/or below the luggage shell(s).

In one such example, the luggage piece may include a first shell, a second shell, and a frame assembly. The frame assembly may include opposing first and second frame members. The first frame member may be joined to the first shell, and the second frame member may be joined to the second shell. The first and second frame members may be pivotably joined together by a hinge. The luggage piece may further include a first carry handle. The first carry handle may pass through the first shell to connect to the first frame member below the first shell. The pivoting axis of the first carry handle may be internal to the luggage case and/or below the first shell.

Still another aspect of the invention may include a luggage piece with a frame assembly. A cross section of the frame assembly may increase across a width of the luggage piece and/or enlarge towards an interior of the luggage piece.

In one such example, the luggage piece may include a first shell, a second shell, and a frame assembly. The frame assembly may include opposing first and second frame members. The first frame member may be joined to the first shell, and the second frame member may be joined to the second shell. The first and second frame members may be pivotably joined together by a hinge. A cross section of the frame assembly may increase across a width of the luggage piece and/or enlarge towards an interior of the luggage piece.

In some examples, the second frame member may be configured with a second recess. Proximate the second recess, an exterior surface of a portion of the second shell adjacent to the second frame member may be substantially flush with an exterior surface of an adjacent portion of the second frame member. When the luggage piece is in a closed configuration, the second recess may be configured to receive therein at least another portion of the first clamp-type latch. The exterior surface of the first clamp-type latch may be substantially flush with an exterior surface of an adjacent portion of the second frame member when the first clamp-type latch is in the latched position.

In some examples, the frame assembly may further include an elastic member. The elastic member may extend around a periphery of the second frame member from one end of the hinge to the other end of the hinge. When the luggage piece is in a closed configuration, the elastic member may be positioned between the first frame member and the second frame member. Exterior surfaces of the elastic member, the first frame member, and the second frame member may define a portion of an exterior surface of the luggage piece.

In some examples, the first frame member may define a width dimension extending away from a periphery of the first shell and a depth dimension transverse the width dimension. The width dimension and the depth dimension vary along a longitudinal dimension of the first frame member.

In some examples, the first frame member may include a greater depth dimension of the first frame member adjacent to or at the first recess.

In some examples, the depth dimension of the first frame member adjacent to or at the first recess may increase towards an interior of the luggage piece.

In some examples, the luggage piece may further include a carry handle pivotally joined to the first frame member. The pivoting axis of the carry handle may be positioned inside an exterior surface of the luggage piece.

In some examples, the first frame member may be configured with recesses for receiving ends of the first carry handle.

In some examples, the first recess of the first frame member and/or the first clamp-type latch may be positioned between the ends of the first carry handle.

In some examples, the first frame member may be adhesively joined to a periphery of the first shell.

In some examples, the first frame member may include a longitudinal recess formed around a periphery of the first frame member. The periphery of the first shell may be received within the longitudinal recess.

In some examples, the first shell may include a flange along the periphery of the first shell. The flange may be offset towards an interior of the luggage piece and received within the longitudinal recess of the first frame member. The first frame member and the first shell may be substantially flush with each other around a substantial portion of, preferably an entirety of, the periphery of the first frame member.

In some examples, the luggage piece may further include second and third clamp-type latches. Each of the second and third clamp-type latches may be received within a respective recess of the frame assembly. Each clamp-type latch may be positioned on different sides of the luggage piece. At least one of the first, second, or third clamp-type latches may include a locking mechanism. The locking mechanism may be a combination locking mechanism.

In some examples, the at least one of, preferably all of, the first, second, or third clamp-type latches may be positioned proximate a center of their respective sides of the luggage piece.

In some examples, the frame assembly may include a greater depth dimension and a greater width dimension at the respective recesses. Exterior surfaces of the first, second and third clamp-type latches may each be substantially flush with or below exterior surfaces of their respective sides of the luggage piece.

Advantageously, the luggage cases as described herein may offer a smooth, clean exterior design since the peripheral components, such as latches or locks and carry handles, are anchored to recesses formed in the frame assembly. The latches or locks and carry handles may be substantially flush with, or even below, the exterior surface of the luggage shells and frame assembly. Accordingly, the exterior size of the luggage case may be increased, thereby increasing the inner compartment size and packing volume. This is especially useful for luggage items that are subject to size restrictions, such as carry-on luggage cases. In addition, receiving peripheral components within recesses of the frame assembly may protect them from abrasions and scuffs, among other things, during usage. Because the peripheral components may be anchored to the frame assembly as opposed to the shells of the luggage case, the shells may be formed of thinner and lighter material that reduces the overall weight of the luggage case. More advantages of the luggage case configuration as described herein may be appreciated by one skilled in the art.

This summary of the disclosure is given to aid understanding, and one of skill in the art will understand that each of the various aspects and features of the disclosure may advantageously be used separately in some instances, or in combination with other aspects and features of the disclosure in other instances.

BRIEF DESCRIPTION OF THE DRAWINGS

The present invention will now be described by way of example only with reference to the following figures in which.

DETAILED DESCRIPTION

Described herein are luggage cases incorporating a frame assembly. The luggage case may include a compartment enclosed by opposing shells, a front shell and a rear shell. Each shell may be a relatively rigid shell formed from any type of material used for hard side suitcases. The frame assembly may include peripheral frame members arranged along the opposing edges/rims of the shells of the luggage case. The luggage case may further include peripheral components, such as locks and handles anchored to the frame assembly. The frame assembly and the peripheral components may be configured to be substantially flush with the outer surface of the luggage shells.

Figure 1:
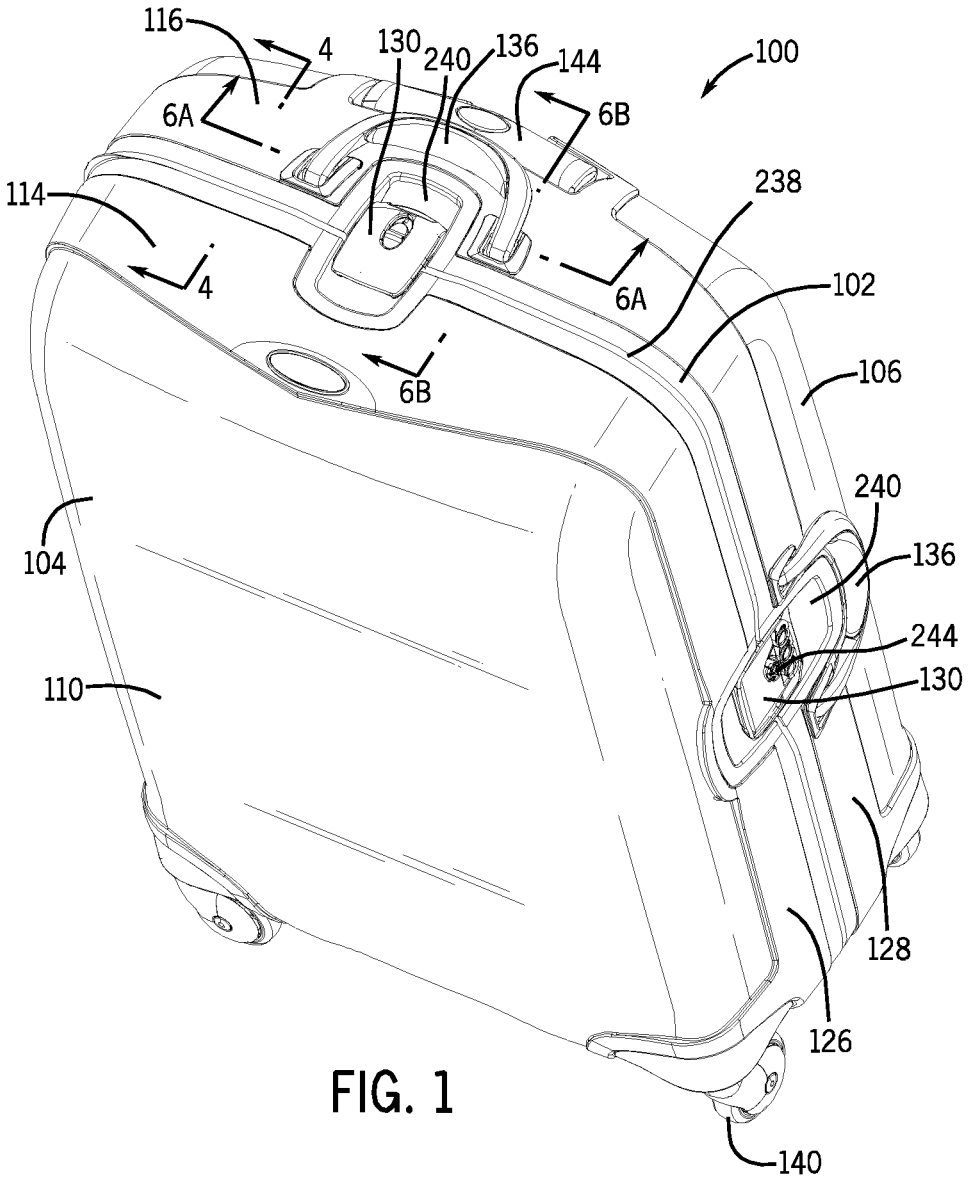
FIG. 1 is a front perspective view of a luggage case incorporating a frame assembly according to one implementation.
Figure 2:
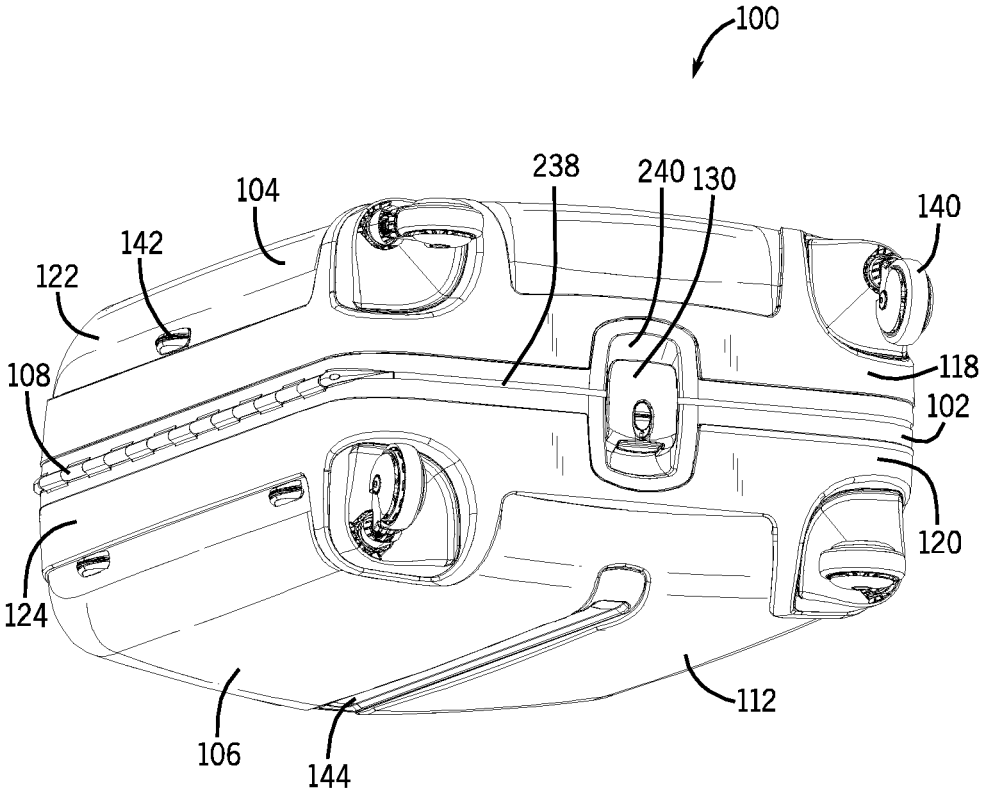
FIG. 2 is a rear perspective view of the luggage case of FIG. 1.
Figure 3:
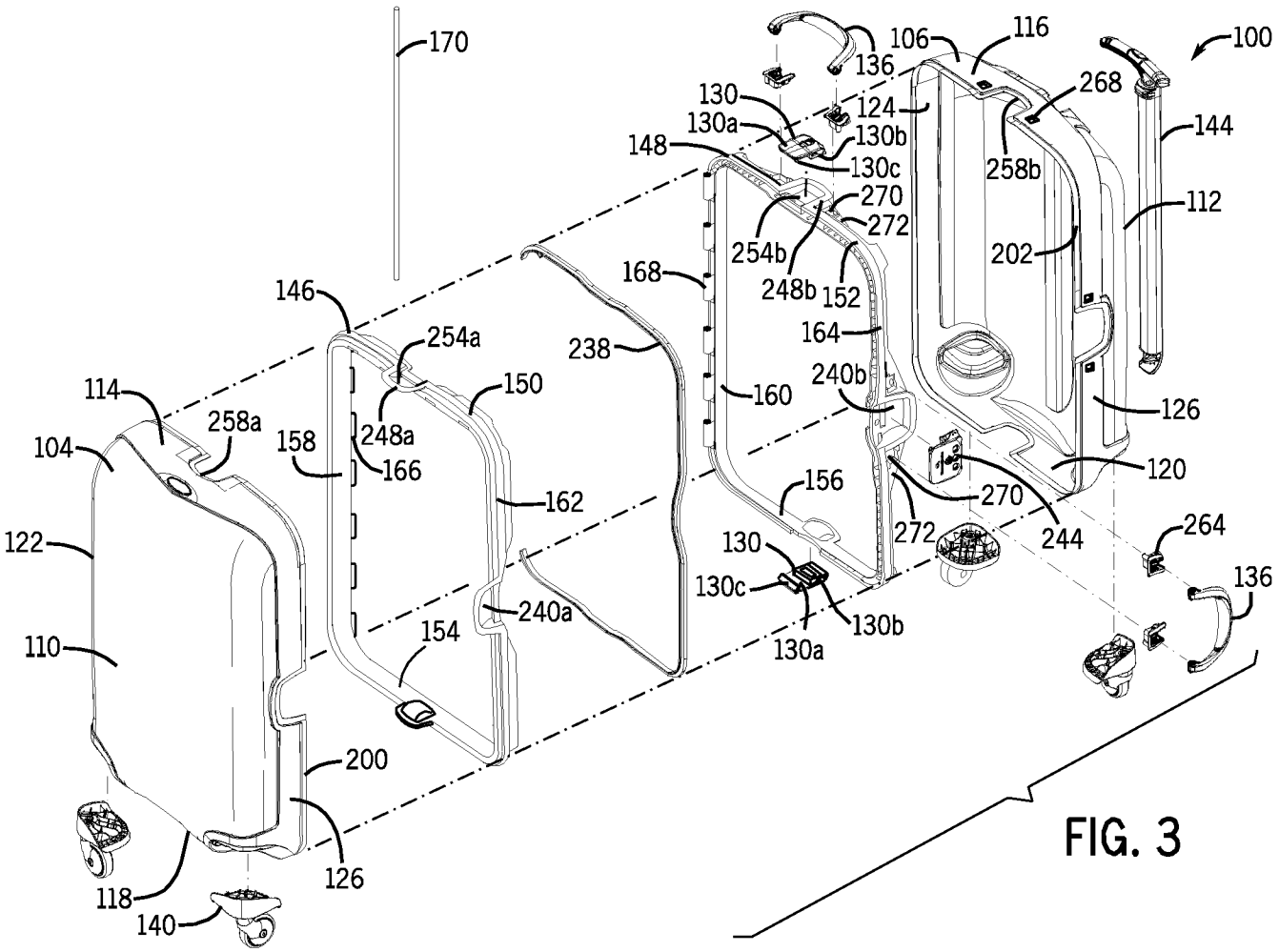
FIG. 3 is an exploded front perspective view of the luggage case of FIG. 1.

By way of example and without limitation, FIGS. 1, 2, and 3 show a luggage case 100 incorporating a frame assembly 102. The luggage case 100 may include a main compartment defined by two opposing shells, for example, a front shell 104 and a rear shell 106, pivotally joined by a hinge member 108, forming in general a parallelepiped shape defining an interior compartment for receiving items. The inner compartment of the luggage case 100 may include inner liners, interior pockets, dividers that may divide the inner compartment into multiple sub-compartments, clips, hooks, hangers, straps, and so on. Each of the front and rear shells 104, 106 may include a major face panel 110, 112, a top panel 114, 116, a bottom panel 118, 120, a left panel 122, 124, and a right panel 126, 128. Each of the top, bottom, left, and right panels 110, 112, 114, 116, 118, 120, 122, 124, 126, 128 defines a peripheral edge or rim, respectively, to which a frame assembly 102, is operably configured. The luggage case 100 may include peripheral components, such as latches or locks 130 and carry handles 136. The peripheral components may be anchored to the frame assembly 102. As will be described in more detail below, the shells 104, 106, the frame assembly 102 and the peripheral components may be configured in a manner such that the frame assembly 102, and the peripheral components may be substantially flush with the outer surface of the luggage shells 104, 106.

The luggage case 100 may include four wheel assemblies 140, such as swivel casters or fixed axle wheels, attached to the corners of the bottom panels 118, 120 of the front and rear shells 104, 106 to assist a user in moving the luggage case 100 along a support surface. In some examples, the luggage case 100 may include a combination of wheel assemblies and feet or other supports. Feet 142 may also be positioned on one or more side panels 122, 124 of the luggage case 100 to allow the luggage case 100 to be supported on, but spaced above, a support surface. The luggage case 100 may also include a telescopic handle 144 to pull or push the luggage case 100.

Figure 4:
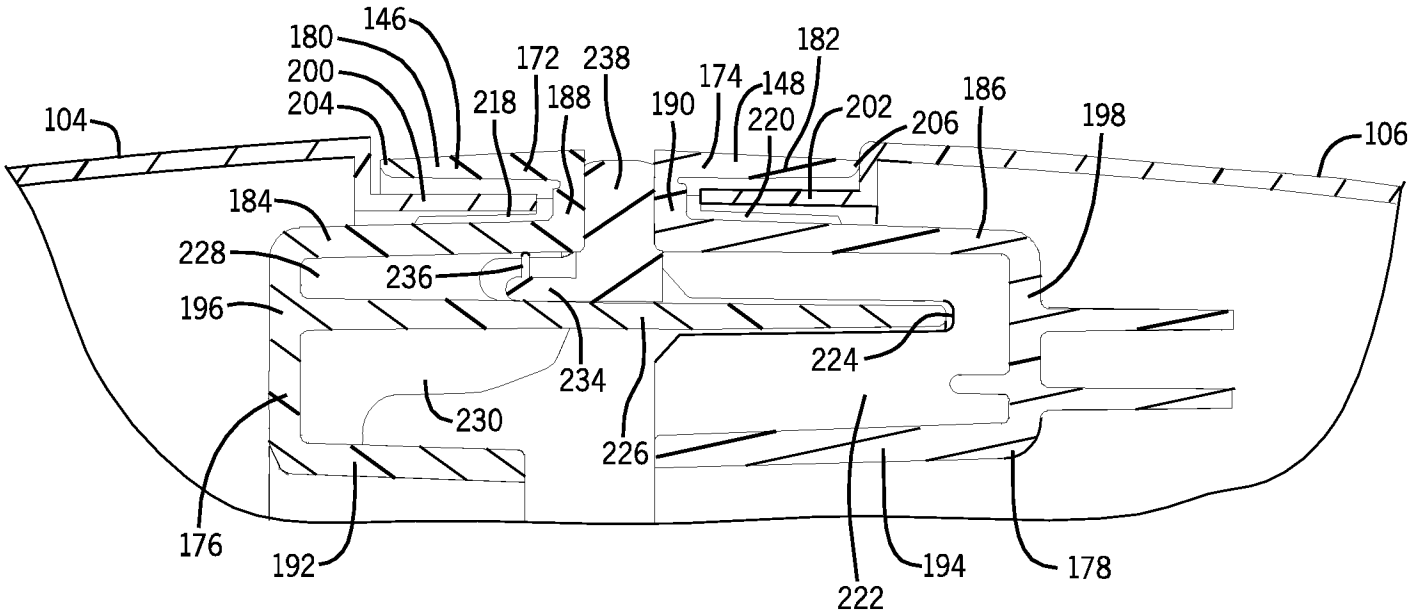
FIG. 4 is a cross section view of the luggage case of FIG. 1, viewed along line 4-4 in FIG. 1.

With reference to FIGS. 3 and 4, the frame assembly 102 may include two opposing frame members: a front frame member 146 and a rear frame member 148. Each of the front and rear frame members 146, 148 may include a top side portion 150, 152, a bottom side portion 154, 156, a left side portion 158, 160, a right side portion 162, 164, and four corner portions each joining two adjacent side portions. The top, bottom, left, and right side portions 150, 154, 158, 162 of the front frame member 146 may be coupled to the peripheral edges of the top, bottom, left, and right panels 114, 118, 122, 126 of the front shell 104, respectively, and the top, bottom, left, and right side portions 152, 156, 160, 164 of the rear frame member 148 may be operably coupled to the peripheral edges of the top, bottom, left, and right panels 116, 120, 124, 128 of the rear shell 106, respectively. Accordingly, the front frame member 146 may also be referred to as the front peripheral frame member 146, and the rear frame member 148 may also be referred to as the rear peripheral frame member 148. The frame assembly 102 may be referred to as the peripheral frame assembly 102.

With reference to FIGS. 2 and 3, the front and rear frame members 146, 148 may be hinged together. The front and rear frame members 146, 148 may include alternating lugs 166, 168 integrally formed along the abutting edges of the front and rear frame members 146, 148 along at least a portion of the left portions 158, 160 of the front and rear frame members 146, 148. A pin or pivot 170 may be positioned through the lugs to form a hinge 108 to rotatably join the front frame member 146 to the rear frame member 148, which further rotatably join the front and rear shells 104, 106 of the luggage case 100. As the front and rear frame members 146, 148 rotate to disengage from each other along the top, bottom, and right portions 150, 152, 154, 156, 162, 164 of each frame member 146, 148 while remaining joined along the hinged portions of the left portions 158, 160 of the front and rear frame members 146, 148, the front and rear shells 104, 106 may pivot with respect to each other to an opened configuration. As the front and rear frame members 146, 148 rotate to engage each other along the top, bottom, left, and right portions 150, 152, 154, 156, 158, 160, 162, 164 of each frame member 146, 148, they may bring the front and rear shells 104, 106 to a closed configuration. Latches and/or locks 130 may be used to releasably secure the front frame member 146 to the rear frame member 148, thereby releasably securing the front shell 104 to the rear shell 106.

With reference to FIG. 4, each of the front and rear frame members 146, 148 may include a shell engagement element 172, 174 and a frame engagement element 176, 178. The shell engagement elements 172, 174 may operably connect the front and rear frame members 146, 148 to the front and rear shells 104, 106, respectively. The frame engagement elements 176, 178 may releasably engage the front and rear frame members 146, 148 to each other. Each of the shell engagement elements 172, 174 may be configured as an outer longitudinal recess or slot with a U-shaped cross section defined by a first or an exterior arm 180, 182, a second or a middle arm 184, 186, and a first or an outer connecting segment 188, 190 joining the exterior and middle arms 180, 182, 184, 186 of each frame member 146, 148. Each of the frame engagement elements 176, 178 may be configured as an inner longitudinal recess with a U-shaped cross section defined by the second or the middle arm 184, 186, a third or an interior arm 192, 194, and a second or an inner connecting segment 196, 198 joining the interior arm 192, 194 and the middle arm 184, 186 of each frame member 146, 148. The outer recess of each of the frame members 146, 148 may open at a side of each frame member 146, 148 that is away from an opening line of the luggage case 100 defined by abutting peripheries of the frame members 146, 148. The inner recess of each one of the frame members 146, 148 may open toward the other one of the frame members 146, 148. As such, each frame member 146, 148 may effectively define an S-shaped cross section, with the outer recesses of the frame members 146, 148 opening opposite to the respective inner recesses of the same frame member 146, 148.

The outer recess of each frame member 146, 148 may extend around a periphery of each frame member 146, 148 abutting the luggage shells 104, 106 to receive the abutting peripheral portions of the top, bottom, left, and right panels 114, 116, 118, 120, 122, 124, 126, 128 of the front and rear shells 104, 106 of the luggage case 100. The outer recess of each frame member 146, 148 may extend around the entire periphery of each frame member 146, 148 or extend only portions of the periphery suitably configured to receive portions of the peripheries of shell panels. With reference to FIGS. 3 and 4, the peripheral portions of the top, bottom, left, and right panels 114, 116, 118, 120, 122, 124, 126, 128 of the front and rear shells 104, 106 may include an indented region or flange 200, 202 that is offset from the exterior surfaces of the shells 104, 106 towards the interior of the luggage case 100 along the longitudinal edges/rims thereof. The indented region or flange 200, 202 may be offset from the exterior surface of the luggage case 100 towards the interior by a suitable distance such that when the shells 104, 106 are engaged to the frame members 146, 148, the exterior surface of the frame members 146, 148 may be substantially flush with, or even below, the exterior surface of the adjacent or abutting shell panels 114, 116, 118, 120, 122, 124, 126, 128. The indented region or flange 200, 202 may be formed along the entire rims/edges of the shells 104, 106 to be received within the outer recesses of the frame members 146, 148. As such, the frame assembly 102 may be substantially flush with or below the outer surface of the luggage shells 104, 106 on all sides of the luggage case 100 along the entire periphery of each frame member 146, 148 that abut the luggage shells 104, 106.

The shells 104, 106 may be adhesively connected to the shell engagement elements 172, 174, of the frame assembly 102. The adhesive (not shown) may be applied between the exterior surface of the indented region or flange 200, 202 of the shell panels 114, 116, 118, 120, 122, 124, 126, 128 and the contacting surface of the exterior arm 180, 182 of the shell engagement elements 172, 174 and/or between the interior surface of the indented region or flange 200, 202 and the contacting surface of the middle arm 184, 186 of the shell engagement elements 172, 174. The indented region or flange 200, 202 of the shell panels 114, 116, 118, 120, 122, 124, 126, 128 and/or the surfaces of the shell engagement elements 172, 174 contacting the indented regions or flanges 200, 202 may include features to enhance the connection between the shells 104, 106 and the shell engagement elements 172, 174.

Figure 7A:
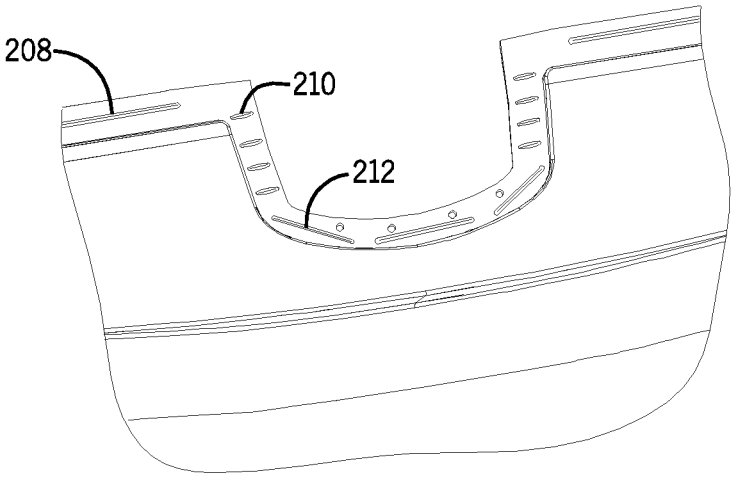
FIG. 7A is a portion of a first example of a luggage shell of the luggage case of FIG. 1.

With reference to FIG. 7A, the shells 104, 106 may include grooves, ridges, and holes formed in the indented region or flange 200, 202 of the shells 104, 106. The grooves may be configured as longitudinal grooves 208 parallel with the edge of the shells 104, 106. The grooves may also be configured as transverse grooves 210 perpendicular to the edge of the shells 104, 106. The grooves may be relatively long continuous grooves 208 extending along a longitudinal portion of the indented region or flange 200, 202. The grooves may be relatively short section grooves 212 to accommodate a varying or curved edge profile of the shells 104, 106. FIG. 7A shows a combination of various grooves formed in the flange 200, 202 of the shell 104, 106. Other combinations of groove types or only one type of groove may be used. The grooves may be straight grooves or may include curves or waves. Depending on the thickness of the shell flange 200, 202, the grooves may be formed on either the exterior or interior surface of the shell flange 200, 202 or both surfaces of the shell flange 200, 202. In some examples, a groove formed on one of the exterior or interior surfaces of the shell flange 200, 202 may form a ridge on the other one of the exterior or interior surfaces of the shell flange 200, 202. Similar grooves may be formed on the interior surface of the outer recesses of the frame members 146, 148 that receive the shell flange 200, 202.

Figure 7B:
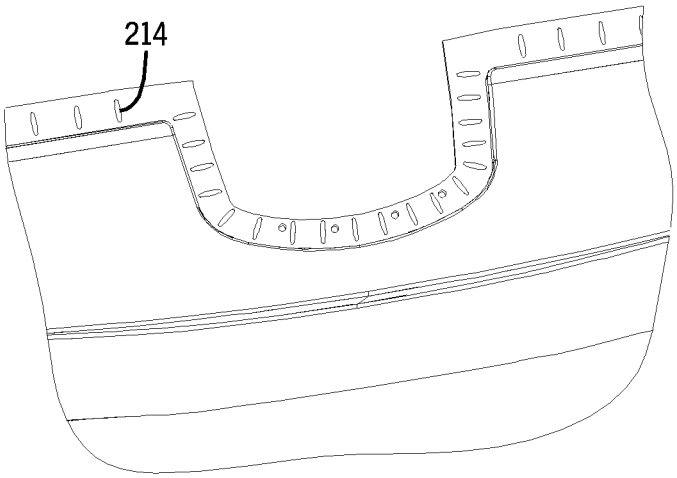
FIG. 7B is a portion of a second example of a luggage shell of the luggage case of FIG. 1.

With reference to FIG. 7B, the shell flanges 200, 202 may be formed with a plurality of ridges 214. The ridges 214 on the surface of the shell flanges 200, 202 (either the exterior or interior surface or both surfaces) may provide a close fit between the shell flanges 200, 202 and the shell engagement elements 172, 174. The ridges 214 may be oriented perpendicular to the edges of the shell flanges 200, 202. The ridges 214 may be oriented in different directions, depending on the profile of the edge of the shell flanges 200, 202. Alternatively, the ridges 214 may be oriented in the same direction, such as parallel to the edges of the shell flanges 200, 202. The ridges 214 may be spaced apart from each other. The spacing may be at substantially equal distances or at random distances along the indented region of flange 200, 202. The ridges 214 formed on the shell flanges 200, 202 may include chamfered surfaces to facilitate insertion of the shell flanges 200, 202 into the outer recesses of the frame members 146, 148.

In continuing reference to FIGS. 7A and 7B, the indented regions or flanges 200, 202 of the shells 104, 106 may also include holes 216 formed therein. The holes 216 may be formed in select regions of the flange 200, 202, such as short and/or curved regions, regions adjacent to which a latch or lock 130 or a carrying handle 136 may be attached, to locally enhance the connection between the shells 104, 106 and the frame members 146, 148. The adhesive in conjunction with the holes 216, grooves 208, 210, 212, and/or ridges 214 of the shell flanges 200, 202 and/or the shell engagement elements 172, 174 provide an improved mechanical interlock and connection therebetween. Similar to the ridges 214, the holes 216 may be spaced apart from each other. The spacing may be at substantially equal distances or at random distances along the intended region of flange 200, 202. The grooves 208, 210 may also be spaced apart from each other at substantially equal or random distances.

Referring back to FIG. 4, the shell engagement elements 172, 174 of the frame members 146, 148 may also include ridges 218, 220 formed on the interior surface of the outer recess. The ridges 218, 220 may be spaced apart from each other at substantially equal or random distances along the length of the frame members 146, 148. The ridges 218, 220 may be of any suitable height to accommodate a range of varying shell thicknesses to form a close fit. The ridges 218, 220 may include chamfered corner surfaces to facilitate insertion of the shell flange 200, 202 into the outer recess. The ridges 218, 220 may also enhance the structural strength of the frame members 146, 148 while keeping the weight thereof low.

In continuing reference to FIG. 4, the frame engagement elements 176, 178 of the front and rear frame members 146, 148 may releasably engage each other in a tongue-and-groove configuration. The inner recesses of the frame engagement elements 176, 178 of each frame member 146, 148 may extend around the abutting peripheries of the front and rear frame members 146, 148 from one end of the hinge 108 of the frame assembly 102 to the other end of the hinge 108. Accordingly, the inner recesses may extend along the entire top, right, bottom sides 150, 152, 154, 156, 162, 164 and portions of the left sides 158, 160 of the front and rear frame members 146, 148. The inner recesses may be configured around any other suitable portions of the frame members 146, 148.

The inner recess of the rear frame member 148 may be configured with U-shaped and/or L-shaped ridges 222 inside the recess. The U-shaped and/or L-shaped ridges 222 may be spaced apart from each other at substantially equal or random distances along the length of the rear frame member 148. The U-shaped and/or L-shaped ridges 222 may collectively define a groove 224 opening toward the front frame member 146. The front frame member 146 may include a transverse extension or tongue 226 (described below), which may be received within the groove 224 of the rear frame member 148 when the frame members 146, 148 engage. The groove 224 may be configured with any suitable width of its opening by suitably configuring the height of the U-shaped and/or L-shaped ridges 222 as so to provide a close fit for the tongue or extension 226 of the front frame member 146.

The inner recess of the front frame member 146 opening toward the rear frame member 148 may include a width similar to the width of the inner recess of the rear frame member 148. The inner recess of the front frame member 146 may be configured with a transverse extension or tongue 226. The transverse extension or tongue 226 of the front frame member 146 may extend parallel to and beyond the two arms 184, 192 of the inner recess of the front frame member 146 from the inner connecting segment 196 of the inner recess into the groove 224 of the rear frame member 148 when the luggage case 100 is closed. To accommodate various peripheral components that may be anchored to the frame assembly 102 (described in more detail below), the tongue 226 of the front frame member 146 may include segments of transverse extensions or may be formed with varying width dimensions (see FIG. 3).

The transverse extension or tongue 246 may divide the inner recess of the front frame member 146 into a middle U-shaped recess to the exterior of the tongue 246 and a smaller inner U-shaped recess to the interior of the tongue 246. Each of the middle and smaller inner recesses may be configured with ridges 228, 230 on the interior surfaces thereof. The ridges 228, 239 may be spaced apart from each other at substantially equal or random distances along the length of the front frame member 146. The ridges 228, 230 may increase the structural strength and provide a close fit between the recesses and the elements received therein. The smaller inner recess may be configured to engage a compartment dividing member, such as a web. The middle recess may be configured to engage an elastic member 232 of the frame assembly 102. Similar to the inner recesses of the front and rear frame members 146, 148, the elastic member 232 may run around the periphery of the front frame member 146 from one end of the hinge 108 to the other end of the hinge 108. The elastic member 232 may run along the entire top, right, bottom sides 150, 154, 162, and portions of the left side 158 of the front frame member 146 or along any suitable portions of the front frame member 146.

The elastic member 232 may include a generally L-shaped cross section. One leg 234 of the L shape may be received within the middle recess of the front frame member 146 and have a protrusion or a hook element 236 configured near the free end of the leg. The protrusion or hook element 236 may be received within an indentation formed in one arm that defines U shape of the middle recess or in a groove traversing the ridges formed on one arm. Adhesives may be used to further secure the elastic member 232 to the front frame member 146. When the luggage case 100 is closed, the other leg 238 of the L-shaped elastic member 232, projecting towards the exterior of the luggage case 100, may be positioned between the front and rear frame members 146, 148 in an abutting relationship with the shell engagement elements 172, 174 of the front and rear frame members 146, 148. This abutting configuration may protect the items inside the luggage case 100 from external contaminants, such as dust or even liquid spills when the front and rear shells 104, 106 are pivoted to the closed configuration. The elastic member 232 may further reduce impact the frame members 146, 148 may have upon each other when they are positioned into an abutting relationship. The elastic member 232 may be visible from the outside of the luggage case 100 and form a portion of the exterior surface of the luggage case 100.

In some examples, the shell engagement elements 172, 174 may be positioned to the exterior of the frame engagement elements 176, 178. In some examples, the frame engagement elements 176, 178 may be located to the exterior of the shell engagement elements 172, 174. The shell flanges 200, 202 may be positioned further toward the interior of the luggage case 100 to form an indentation, which is sufficiently deep to house both the shell engagement elements 172, 174 and the frame engagement elements 176, 178 and keep the exterior surface of the frame assembly 102 substantially flush with the exterior surface of the luggage shells 104, 106. The front and rear frame members 146, 148 may be engaged by a tongue-and-groove configuration described above. Alternatively, the rear frame member 148 may include a transverse extension or tongue, and the front frame member 146 may be configured with a groove for receiving the tongue of the rear frame member 148. Other suitable engagement mechanisms or configurations may be implemented.

With reference to FIGS. 1, 2, and 3, the luggage case 100 may include one or more latches 130 for releasably securing the front shell 104 to the rear shell 106 of the luggage case 100. Preferably, the luggage case 100 may include three latches 130, one on the top, one on the side, and one on the bottom of the luggage case 100. More preferably, each latch 130 may be positioned proximate or at the center of each side of the luggage case 100. Each latch 130 may be a clamp-type latch having a latch plate 130*a*. One end of the latch plate 130*a* may be movably joined to one of the frame members 146, 148 by a link assembly 130*b*, and the other end of the latch plate 130*a* may be formed with a hook or a similar component 130*c*, which may be configured to releasably engage the other one of the frame members 146, 148. When positioned in a latched position, an exterior surface of the latch 130, including the exterior surface of the latch plate 130*a*, may be substantially flush with adjacent portions of the frame members 146, 148.

For each latch 130, the frame assembly 102 may include a respective recess 240 to receive the latch 130 therein (see FIGS. 1 and 2). Each recess 240 may extend transversely relative to an opening line of the luggage case 100. The frame assembly 102 may be configured with increased width dimensions towards major face panels 110, 112 of the luggage case 100 where the recesses 240 are positioned. Each of the recesses 240 may be configured with a suitable depth such that the exterior surface of the latch 130 received therein may be substantially flush with the exterior surface of adjacent portions of the frame assembly 102, which may be substantially flush with the exterior surface of adjacent portions of the luggage shells 104, 106 as described earlier. Such a configuration may maximize the exterior size of the luggage case 100 as well as the inner compartment size defined by the luggage shells 104, 106. This is especially useful for carry-on luggage case 100s, which are subject to size restrictions and allowable dimensions are usually measured between outermost points. Configuring the latches 130 within exterior recesses 240 of the frame assembly 102 and substantially flush with the luggage shells 104, 106 when positioned in a latched position may also protect the latches 240 from abrasions, scuffs, and the like during usage.

Each recess 240 may be formed in the middle portion of each side of the frame assembly 102 so as to position the latch 130 received therein to be in a center location of each side of the luggage case 100. When the luggage case 100 is lifted by a carry handle 136, such a configuration may allow the latches 130 above and below the center of gravity of the luggage case 100 to be vertically aligned with the center of gravity and prevent the latches 130 from opening. Different locations of the latches 130 on each side of the luggage case 100 may be contemplated for other considerations. One or more of the latches 130 may be configured with a locking mechanism 244, such as a combination lock, to prevent unauthorized access to the inner compartment of the luggage case 100.

With further reference to FIGS. 1, 2, and 3, each recess 240 may be collectively defined by a recessed portion 240*a* formed in the exterior of the top, bottom, or right side 150, 154, 162 of the front frame member 146, and a recessed portion 240*b* formed in the exterior of a corresponding side 152, 156, 164 of the rear frame member 148. Each recessed portion 240*a*, 240*b* of the front and rear frame members 146, 148 may be defined by a generally U-shaped peripheral frame portion 248*a*, 248*b*. The U-shaped peripheral frame portion 248*a*, 248*b* may extend around a concaved frame surface 254*a*, 254*b*. The U-shaped peripheral frame portion 248*a* of the front frame member 146 may be curved away from the opening line of the luggage case 100 and toward the major face panel 110 of the front shell 104 and open towards the rear frame member 148. The U-shaped peripheral frame portion 248*b* of the rear frame member 148 may be curved away from the opening line of the luggage case 100 and toward the major face panel 112 of the rear shell 106 and open towards the front frame member 146. Accordingly, the frame assembly 102 may include increased width dimensions toward either major face panels 110, 112 of the front or rear shells 104, 106 where the recesses 240 are formed for housing a latch or lock 130 therein.

Each U-shaped peripheral frame portion 248*a*, 248*b* may be configured with a width dimension substantially the same as the other longitudinal portions of the frame members 146, 148 and have an exterior surface substantially flush with the adjacent shell panels 114, 116, 118, 120, 126, 128. The U-shaped peripheral frame portions 248*a*, 248*b* may engage the adjacent shell periphery in a manner the same as or similar to that described above with respect to other longitudinal portions of the frame members 146, 148 in reference to FIG. 4. The front and rear shells 104, 106 may include U-shaped recesses or cutout 258*a*, 258*b* at the rims/edges of the top, right and/or bottom side panels 114, 116, 118, 120, 126, 128 where the recesses 240 of the frame assembly 102 is configured (FIG. 3). The recessed or cutout portions 258*a*, 258*b* of the front and rear shells 104, 106 may be configured with an indented region or flange 200, 202 similar to that of the other peripheral portions of the shells 104, 106.

With further reference to FIG. 3, the concaved frame surface 254*b* of the recessed portion 240*b* of the rear frame member 148 may be configured with a mounting seat 260. A latch having a latch plate 130*a* and a link assembly 130*b* may be joined to the rear frame member 148 by joining the link assembly 130*b* to the mounting seat 260 by mechanical fasteners, or shafts, axles, pins or the like. The latch plate 130*a* may be movably joined to the link assembly 130*b* at one end of the latch plate 130*a* and include a hook or a similar component 130*c* at the other end of the latch plate 130*a*. The concaved frame surface 254*a* of the front frame member 146 may include a catch 262 in the form of a lip for releasably engaging the hook or similar component 260 of the latch plate 130*a*. Alternatively, the concaved surface 254*a* of the front frame member 146 may include a structure for mounting a latch 130 therein, and the concaved surface 254*b* of the rear frame member 148 may include a catch 262 for releasably engaging the latch 130.

The recessed portions 240*a*, 240*b* of the front and rear frame members 146, 148 may have suitable depths such that the exterior surface of the latch or lock 130 received therein may be substantially flush with the exterior surface of adjacent portions of the frame assembly 102 and the luggage shells 104, 106 as described above when the latch 130 is positioned in a latched position. Preferably, at the recesses 240 of the frame assembly 102 where the latches or locks 130 may be configured, each frame member 146, 148 of the frame assembly 102 may have an increased thickness toward the interior of the luggage case 100. As such, the latches or locks 130, when in a latched position, may not only be substantially flush with or below the adjacent portions of the frame members 146, 148 and luggage shells 104, 106 proximate the recesses 240, but also substantially flush with the entire frame assembly 102 and luggage side panels on the same side of the luggage case 100.

Figure 5:
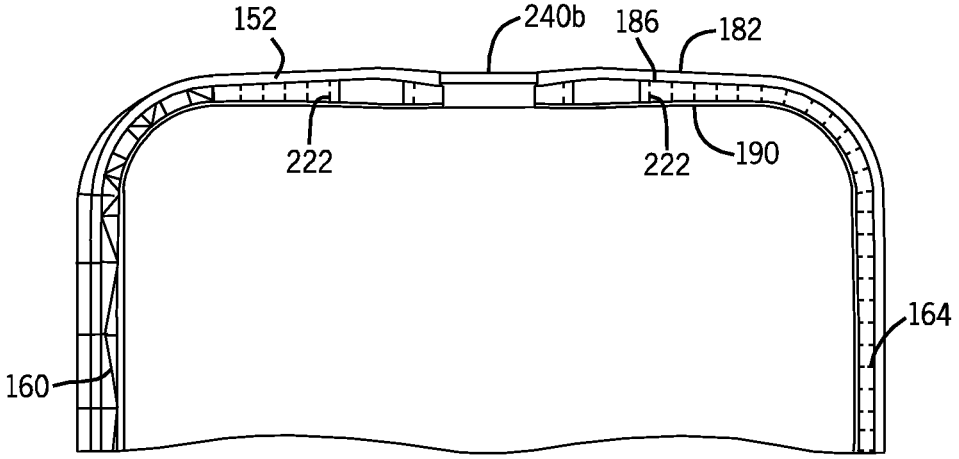
FIG. 5 is a front view of an upper portion of a rear frame member of the frame assembly of the luggage case of FIG. 1.

With reference to FIG. 5, which shows an upper portion of the rear frame member 148, the exterior arm 182 and the middle arm 186 that define the outer U-shaped recess of the rear frame member 148 may curve toward the interior of the luggage case 100 at the recessed portion 240*b*. The interior arm 190 that defines in part the inner U-shaped recess of the rear frame member 148 may also be slightly curved toward the interior of the luggage case 100. Specifically, the interior arm 190 may extend from the left top corner and the right top corner of the rear frame member 148 toward where the recessed portion 240*b* is formed, for example, the center of the top side portion 152 of the rear frame member 148, and at the same time curve slightly toward the interior of the luggage case 100. The ridges 222 formed on the interior arm 190 may include gradually increased height dimensions near the recessed portion 240*b*. This may help to maintain the close fit between the tongue-and-groove engagement between the front and rear frame members 146, 148.

In a similar manner, the thickness of the top side portion 150 of the front frame member 146 may be increased toward the interior of the luggage case 100 at the recessed portion 240*a*. The right and/or bottom side portions 162, 164, 154, 156 of the front and rear frame members 146, 148 may increase in thickness towards the interior of the luggage case 100 at the recessed portions 240*a*, 240*b* for receiving latches 130 therein.

Increasing the frame thickness towards the interior of the luggage case 100 may allow the latches 130, when received in the recess 240 in a latched position, to be substantially flush with, or even below, the exterior surfaces of the frame members 146, 148 and the shells 104, 106 of the luggage case 100. A substantially flush exterior surface may maximize the exterior size of the luggage case 100 as well as the inner compartment size as discussed above. In addition, test results show that frame members formed with a substantially flush exterior surface and a slightly inward curved interior surface may be stiffer and harder to deform compared with a frame member formed with parallel exterior and interior surfaces.

Figure 6A:
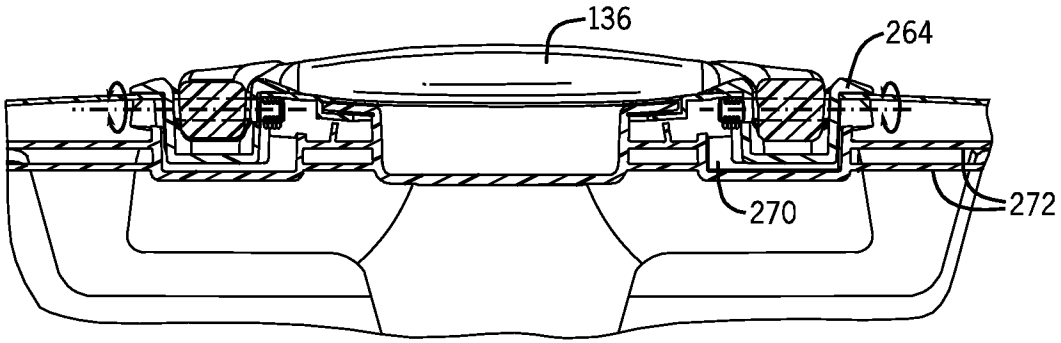
FIG. 6A is a cross section view of the luggage case of FIG. 1, viewed along line 6A-6A in FIG. 1, with the locking mechanism removed for clarity.
Figure 6B:
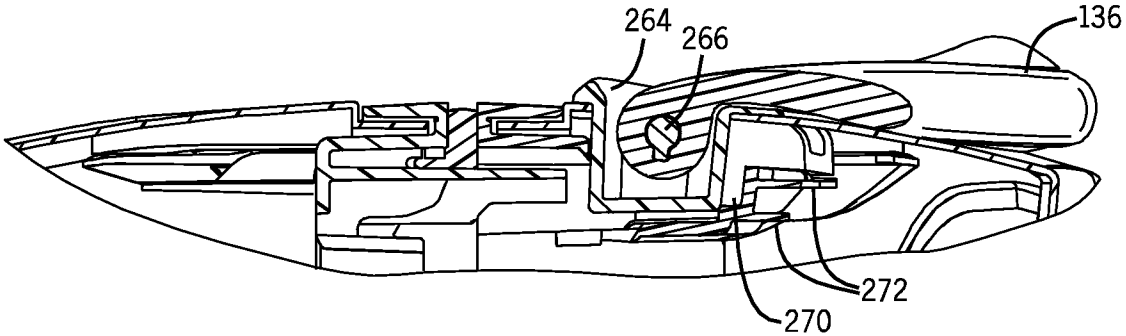
FIG. 6B is a cross section view of the luggage case of FIG. 1, viewed along line 6B-6B in FIG. 1.

With reference to FIGS. 1, 2, 3, 6A, and 6B, the luggage case 100 may include one or more carry handles 136 positioned at one or more sides of the luggage case 100. Each carry handle 136 may be transversely offset from the opening line of the luggage case 100. The ends of the carry handles 136 may each be received in a housing or collar member 264 and pivotally secured therein by a pivot pin 266. The housing or collar members 264 may each be positioned through an aperture 268 formed in the luggage shell 106 (see FIG. 3) and received within vertical recesses 270 formed in a lip or transverse extension 272 (described below) of the rear frame member 148 below or to the interior of the shell 106 of the luggage case 100. Accordingly, the pivoting axis of the carry handle 136 and/or at least a portion, or the entirety, of the pivoting ends of the carry handle 136 may be positioned below the exterior surface of the luggage shell 106 within the vertical recesses 270 of the frame assembly 102 (FIGS. 6A and 6B). The carry handles 136 may be anchored to either the front frame member 146 or the rear frame member 148. The ends of the carry handles 136 may be symmetrically positioned with respect to the latches or locks 130 on the same side of the luggage case 100. The latches or locks 130 and the recesses 240 receiving the latches or locks 130 may be positioned between the ends of the carry handles 136.

In continuing reference to FIGS. 3, 6A, and 6B, the lips or transverse extensions 272 may be formed on either side of one or more of the recessed portions 240*b* of the frame member 146, extending from the side walls of the recesses 240*b* and adjacent portions of the frame engagement member 178 towards the major face panel 112 of the shell 106. The lips or transverse extensions 272 of the frame member 146 may include varying width dimensions, which may gradually reduce from the recessed portions 240*b*, or the middle portion of the frame member 146, towards the corners portions of the frame member 146. Accordingly, the frame member 146 may include a varying width dimension, with the center portion being relatively wide and gradually decreasing as the frame member 146 extends longitudinally towards either side. In some examples, the width dimension may increase again at the corners of the frame member 146 since a corner reinforcing member in the form of a transverse extension may be arranged.

Each lip or transverse extension 272 may include a vertical recess 270 toward the interior of the luggage case 100, in which a housing or collar member 264 of the carry handle 136 may be received. The housing or collar members 264 may be held in place within the vertical recesses 270 by fasteners, adhesive, set screws and so on. Each lip or transverse extension 272 may include a multi-layer structure formed by more than one layers of extensions, and ribs may be formed between layers of extensions to improve structural strength thereof.

Anchoring the ends of the carry handles 136 to the vertical recesses 270 of the frame assembly 102 below the luggage shells 106 may allow the ends of the carry handles 136 to be configured with sufficient thickness for strength without raising the exterior profile of the luggage case 100. The portions of the carrying handle 136 that connect the ends and the grip portion of the carry handle 136 may be formed with a relatively flat or thin profile. Carry handles 136 configured as such may lay substantially flat against the exterior surface of the shell 106 and become less visible when viewed from the front of the luggage case 100. Similar to configuring the latches or locks 130 within transverse recesses 240 of the frame assembly 102, receiving the ends of the carry handle 136 within vertical recesses 270 of the frame assembly 102 and using thin or flat handle portions may maximize the exterior size as well as the inner compartment size of the luggage case 100. In addition, since the latches or locks 130 and the handles 136 may be anchored to the frame assembly 102 instead of the luggage shells 104, 106, the luggage shells 104, 106 may be formed relatively thin, with a shell or sheet thickness ranging between 0.5 mm to 2 mm, preferably between 0.5 mm to 1.5 mm, more preferably 0.5 mm to 1.2 mm. Further, because lifting or pulling forces applied on the carry handles 136 are transferred to the frame assembly 102 instead of directly on the shells 104, 106, the shells 104, 106 may experience little or no forces that may pull the shells 104, 106 away from the engagement with the shell assembly 102.

The frame members 146, 148 of the frame assembly 102 may be formed by injection molding. The shells 104, 106 of the luggage case 100 may be formed by thermoforming. Laser cutting may be utilized to form cutout along the edge/rim of the luggage shells 104, 106. The frame members 146, 148 and/or the luggage shells 104, 106 described herein may be formed using plastic materials including, but not limited to, polyethylene (PE), polypropylene (PP), polyvinyl chloride (PVC), acrylonitrile butadiene styrene (ABS), poly carbonate (PC), polyamide (PA), polybutylene terephthalate (PBT), and so on.

It should be noted that all directional and/or dimensional references (e.g., upper, lower, upward, downward, left, right, leftward, rightward, top, bottom, above, below, front, back, rear, forward, backward, rearward, inner, outer, inward, outward, vertical, horizontal, clockwise, counterclockwise, length, width, height, depth, and relative orientation) are only used for identification purposes to aid the reader's understanding of the implementations of the disclosed invention(s), and do not create limitations, particularly as to the position, orientation, use relative size or geometry of the invention(s) unless specifically set forth in the claims.

Connection references (e.g., attached, coupled, connected, joined, and the like) are to be construed broadly and may include intermediate members between a connection of elements and relative movement between elements. As such, connection references do not necessarily infer that two elements are directly connected and in a fixed relation to each other.

In some instances, components are described with reference to "ends" having a particular characteristic and/or being connected with another part. However, those skilled in the art will recognize that the disclosed invention(s) is not limited to components that terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made that are within the scope of the appended claims.

The invention claimed is:

1. A luggage piece, comprising:

a first shell;

a second shell;

a frame assembly including opposing separate first and second frame members, the first frame member joined to the first shell, the second frame member joined to the second shell, and the first and second frame members pivotably joined together by a hinge; and a first clamp-type latch joined to the frame assembly and configured to releasably secure the first shell to the second shell;

wherein the first frame member includes a first recess, the first recess receives therein at least a portion of the first clamp-type latch; proximate the first recess, an exterior surface of a portion of the first shell adjacent to the first frame member is substantially flush with an exterior surface of an adjacent portion of the first frame member; and an exterior surface of the first clamp-type latch is substantially flush with an exterior surface of an adjacent portion of the first frame member when positioned in a latched position.

2. The luggage piece according to claim 1, wherein the second frame member is configured with a second recess; proximate the second recess, an exterior surface of a portion of the second shell adjacent to the second frame member is substantially flush with an exterior surface of an adjacent portion of the second frame member; when the luggage piece is in a closed configuration, the second recess is configured to receive therein at least another portion of the first clamp-type latch, and the exterior surface of the first clamp-type latch is substantially flush with an exterior surface of an adjacent portion of the second frame member when in the latched position.

3. The luggage piece according to claim 2, wherein the frame assembly further comprises:

an elastic member extending around a periphery of the second frame member from one end of the hinge to the other end of the hinge;

when the luggage piece is in a closed configuration, the elastic member is positioned between the first frame member and the second frame member; and exterior surfaces of the elastic member, the first frame member, and the second frame member define a portion of an exterior surface of the luggage piece.

4. The luggage piece according to claim 1, wherein the first frame member defines a width dimension extending away from a periphery of the first shell and a depth dimension transverse the width dimension, and the width dimension and the depth dimension vary along a longitudinal dimension of the first frame member.

5. The luggage piece according to claim 4, wherein the first frame member includes a greater depth dimension of the first frame member adjacent to or at the first recess.

6. The luggage piece according to claim 5, wherein the depth dimension of the first frame member adjacent to or at the first recess increases towards an interior of the luggage piece.

7. The luggage piece according to claim 1, further comprising a first carry handle pivotally joined to the first frame member, and a pivoting axis of the first carry handle is positioned inside an exterior surface of the luggage piece.

8. The luggage piece according to claim 7, wherein the first frame member is configured with recesses for receiving ends of the first carry handle.

9. The luggage piece according to claim 8, wherein the first recess of the first frame member and/or the first clamp-type latch is positioned between the ends of the first carry handle.

10. The luggage piece according to claim 1, wherein the first frame member is adhesively joined to a periphery of the first shell.

11. The luggage piece according to claim 10, wherein the first frame member comprises a longitudinal recess formed around a periphery of the first frame member, and the periphery of the first shell is received within the longitudinal recess.

12. The luggage piece according to claim 11, wherein the first shell comprises a flange along the periphery of the first shell, the flange is offset towards an interior of the luggage piece and received within the longitudinal recess of the first frame member; the first frame member and the first shell are substantially flush with each other around a substantial portion of the periphery of the first frame member.

13. The luggage piece according to claim 11, wherein the first shell comprises a flange along the periphery of the first shell, the flange is offset towards an interior of the luggage piece and received within the longitudinal recess of the first frame member; the first frame member and the first shell are substantially flush with each other around an entirety of the periphery of the first frame member.

14. The luggage piece according to claim 1, further comprising second and third clamp-type latches, each of the second and third clamp-type latches being received within a respective recess of the frame assembly; each clamp-type latch is positioned on different sides of the luggage piece; and at least one of the first, second or third clamp-type latches including a locking mechanism, preferably a combination locking mechanism.

15. The luggage piece accordingly to claim 14, wherein the at least one of the first, second, or third clamp-type latches is positioned proximate a center of their respective sides of the luggage piece.

16. The luggage piece accordingly to claim 14, wherein each of the first, second, and third clamp-type latches is positioned proximate a center of their respective sides of the luggage piece.

17. The luggage piece according to claim 14, wherein the frame assembly includes a greater depth dimension and a greater width dimension at the respective recesses; and exterior surfaces of the first, second, and third clamp-type latches are each substantially flush with or below exterior surfaces of their respective sides of the luggage piece.

* * * * *